US007546045B2

(12) United States Patent
Noguchi et al.

(10) Patent No.: US 7,546,045 B2
(45) Date of Patent: Jun. 9, 2009

(54) IMAGE FORMING APPARATUS HAVING IMAGE PLACEMENT CONTROL AND METHOD OF CONTROLLING SAME

(75) Inventors: Junichi Noguchi, Suzhou (CN); Takashi Kanno, Kashiwa (JP); Takashi Soya, Abiko (JP); Shinichi Takata, Abiko (JP); Shigemichi Hamano, Abiko (JP); Kiyoshi Okamoto, Moriya (JP); Katsuyuki Yamazaki, Toride (JP); Tomoichiro Ohta, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 462 days.

(21) Appl. No.: 11/431,616

(22) Filed: May 11, 2006

(65) Prior Publication Data

US 2006/0285863 A1 Dec. 21, 2006

(30) Foreign Application Priority Data

May 31, 2005 (JP) ..... 2005-159938

(51) Int. Cl.
*G03G 15/00* (2006.01)

(52) U.S. Cl. ..... 399/49

(58) Field of Classification Search ..... 399/49, 399/72, 66, 179, 182, 299, 302; 358/1.18
See application file for complete search history.

(56) References Cited

U.S. PATENT DOCUMENTS 6,574,442 B2 * 6/2003 Kibune ..... 399/49
6,731,889 B2 * 5/2004 Nakayama ..... 399/49
7,324,769 B2 * 1/2008 Yamaoka ..... 399/49
7,418,216 B2 * 8/2008 Elliot et al. ..... 399/49
2007/0133056 A1 * 6/2007 Noguchi et al. ..... 358/1.18

FOREIGN PATENT DOCUMENTS

JP 01312558 A * 12/1989
JP 7-234612 9/1995
JP 2001209270 A * 8/2001
JP 2002-91096 3/2002
JP 3450402 7/2003
JP 2003241450 A * 8/2003
JP 2004-252028 A 9/2004
JP 2004279823 A * 10/2004

* cited by examiner

*Primary Examiner*—Robert Beatty
(74) *Attorney, Agent, or Firm*—Fitzpatrick, Cella, Harper & Scinto

(57) ABSTRACT

Disclosed is an image forming apparatus whereby waiting time (downtime), which is required for forming an image by automatic adjustment relating to image formation density or image formation position, is made shorter than in the prior art. When an image having a size equal to or less than a prescribed size is formed is formed in this apparatus, the image to be formed is placed on an image carrier in such a manner that a vacant area for forming an adjustment pattern can be reserved on the image carrier. As a result, automatic adjustment relating to image formation density or image formation position can be executed while an image is formed.

12 Claims, 11 Drawing Sheets

IMAGE FORMING APPARATUS HAVING IMAGE PLACEMENT CONTROL AND METHOD OF CONTROLLING SAME

FIELD OF THE INVENTION

This invention relates to an image forming apparatus that employs electrophotography or electrostatic printing.

BACKGROUND OF THE INVENTION

In general, a color image forming apparatus uses a developing material (toner) to form a visible image (a toner image) from an electrostatic latent image that has been formed on a photosensitive drum, and transfers the formed visible image to an intermediate transfer member by a first transfer. The primary transfer is executed in the order of the colors used, e.g., yellow, magenta, cyan and black. This means that a plurality of toner images of different colors are transferred to the intermediate transfer member in a multiple-transfer operation. The color image forming apparatus then transfers the multiple-transferred toner images to a transfer member collectively by a secondary transfer. It should be noted that a color image forming apparatus having just one photosensitive drum and a color image forming apparatus having a plurality of photosensitive drums exist.

In an image forming apparatus of this kind, a so-called "density shift" occurs for every color owing to amount of toner remaining in a developing device and a fluctuation in transfer characteristic ascribable to atmospheric temperature. Further a so-called "color misregistration" also can occur in an image forming apparatus that uses a plurality of photosensitive drums. Color misregistration is caused by the fact that the positions at which toner images of the respective colors are formed do not coincide owing to mechanical installation error between the photosensitive drums, an error in optical path lengths of the laser light beams and a change in these optical paths.

In general, a "density shift" is adjusted automatically by the following procedure: First, a reference pattern based upon a toner image is formed on a photosensitive drum or intermediate transfer belt. Next, the density of the toner image that has been formed is sensed by a photosensor. Process conditions and a correction value of a gamma characteristic are then controlled automatically in such a manner that the result of sensing density becomes a prescribed value. As a result, image density can be stabilized.

"Color misregistration", on the other hand, is adjusted automatically by the following procedure: First, a reference pattern that has been formed on the intermediate transfer member is read by a photosensor placed in close proximity to a photosensitive drum situated immediately downstream. Based upon the result of reading the reference pattern, color misregistration on the intermediate transfer member is then sensed for every color formed by each image forming portion. The output timing of the image signal to be printed and the image signal itself are electrically adjusted automatically so as to cancel out this color misregistration. It should be noted that the optical path length and the optical path also may be adjusted automatically by driving a bending mirror provided in the optical path of the laser beam.

With such automatic adjustment (see the specification of Japanese Patent No. 3450402), it is usually necessary to perform a maximum density correction and gray scale correction on a color-by-color basis. Further, in relation also to automatic adjustment of color misregistration, it is necessary to form a reference pattern a plurality of times in order to reduce error such as drive-system eccentricity. As a consequence, executing the automatic adjustment can take several minutes.

Furthermore, when images are formed successively on a plurality of sheets of paper, the automatic adjustments are executed from the end of image formation on a certain sheet of paper to the beginning of image formation on the next sheet of paper. In this case, formation of the next image cannot be performed until the automatic adjustments are completed. This results in a decline in productivity and requires that the operator wait.

The specification of Japanese Patent Application Laid-Open No. 2002-91096 proposes an automatic adjustment method that is capable of changing the number of image-pattern formations in accordance with the intervals at which a plurality of sheets of paper are transported.

However, an increase in the speed of image forming systems and an improvement in the productivity thereof are accompanied by a shortening in the transport interval of paper sheets. With the method described in Japanese Patent Application Laid-Open No. 2002-91096, however, there is the danger that the reference pattern cannot be formed satisfactorily.

An object of the present invention is to solve this problem and at least one other problem of the prior art. Other problems of the prior art will be understood through a reading of the entire specification.

SUMMARY OF THE INVENTION

In accordance with the present invention, the foregoing object is attained by providing an image forming apparatus comprising an image carrier for supporting an image produced by a developing material; an image placement portion; an image forming portion; a reading portion for reading an adjustment pattern; and an adjustment portion. When an image whose size is equal to or less than a prescribed size is formed, the image placement portion decides placement of the image on the image carrier in such a manner that a vacant area, which is provided for forming an adjustment pattern for adjusting at least one of an image formation position and image formation density, is reserved on the image carrier. The image forming portion forms the image, the placement of which has been decided by the image placement portion, on the image carrier and forms the adjustment pattern in the vacant area. The adjustment portion adjusts at least one of the image formation position and image formation density.

In accordance with the present invention, when an image whose size is equal to or less than a prescribed size is formed, the image to be formed is intentionally placed on the image carrier in such a manner that the vacant area provided for forming the adjustment pattern can be reserved on the image carrier. As a result, automatic adjustment of image formation density and image formation position can be executed automatically while an image is formed. This is advantageous in that downtime due to automatic adjustment can be shortened over that of the prior art.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

<Example of Structure>

Figure 1:
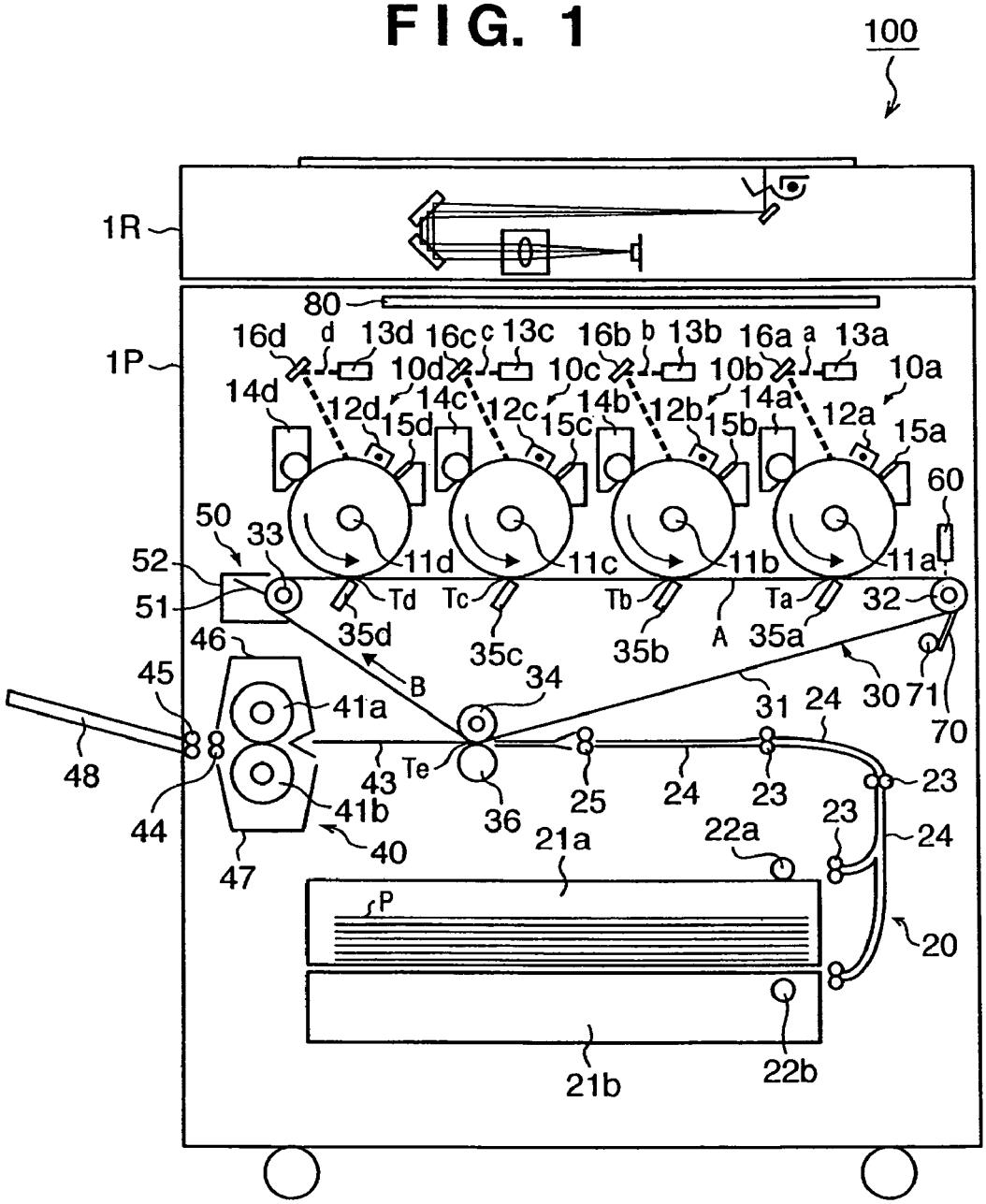
FIG. 1 is a schematic sectional view illustrating the overall structure of an image forming apparatus according to a first embodiment of the present invention.

FIG. 1 is a schematic sectional view illustrating the overall structure of an image forming apparatus according to an embodiment of the present invention. An electrophotographic color copier in which a plurality of image forming portions are arranged in parallel and which employs an intermediate transfer method will be described as an example of an image forming apparatus.

In this embodiment, an electrophotographic color copier 100 has an image reader 1R and an image output unit 1P. The image reader 1R reads the image of an original optically, converts the image to an electric signal and transmits the electric signal to the image output unit 1P. The image output unit 1P has four image forming portions 10*a*, 10*b*, 10*c*, 10*d* (referred to singly simply as "image forming portion 10") arranged in parallel, a paper feed unit 20, an intermediate transfer portion 30, a fixing unit 40, cleaning portions 50 and 70, a photosensor 60 and a control portion 80.

The image forming portions 10 basically have a similar construction. That is, drum-shaped electrophotographic photosensitive members serving as first image carriers, namely photosensitive drums 11*a*, 11*b*, 11*c*, 11*d* (referred to singly simply as "photosensitive drum 11"), are axially supported for free rotation in respective ones of the image forming portions 10 and are rotatively driven in the directions of the arrows. Arranged facing the outer peripheral surface of respective ones of the photosensitive drums 11 are primary charging devices 12*a*, 12*b*, 12*c*, 12*d* (referred to singly simply as "charging device 12"), optical systems 13*a*, 13*b*, 13*c*, 13*d* (referred to singly simply as "optical system 13"), bending mirrors 16*a*, 16*b*, 16*c*, 16*d* (referred to singly simply as "bending mirror 16"), developing units 14*a*, 14*b*, 14*c*, 14*d* (referred to singly simply as "developing unit 14") and cleaning portions 15*a*, 15*b*, 15*c*, 15*d* (referred to singly simply as "cleaning portion 15").

The charging device 12 applies a uniform electric charge to the surface of the photosensitive drum 11. Next, an electrostatic latent image is formed by causing a light beam (e.g., a laser beam), which has been emitted by the optical system 13, to expose the photosensitive drum 11 via the bending mirror 16. It goes without saying that the light beam has been modulated in accordance with an image signal that has been output from the image reader 1R or control portion 80.

Furthermore, the latent images are visualized by respective ones of the developing units 14 containing respective ones of four-color developing materials (referred to as "toner" below), namely yellow, cyan, magenta and black toners. The visualized images (toner images) are transferred by primary transfer to an intermediate transfer belt 31 at respective ones of image transfer areas Ta, Tb, Tc and Td. The intermediate transfer belt 31 is a belt-shaped intermediate transfer member and functions as a second image carrier that constitutes the intermediate transfer portion 30.

The cleaning portion 15 cleans off the surface of the photosensitive drum 11 downstream of the image transfer areas Ta, Tb, Tc, Td by scraping off the toner remaining on the photosensitive drum 11 without allowing the remaining toner to be transferred. By virtue of the process set forth above, image formation by each toner is executed.

The paper feed unit 20 has cassettes 21*a*, 21*b* (referred to as "cassette 21" below) accommodating transfer material P, and pick-up rollers 22*a*, 22*b* ("pick-up roller 22" below) for feeding the transfer material P from the cassettes 21*a*, 21*b* one sheet at a time. The paper feed unit 20 further includes a pair of paper feed rollers 23, which further transport the transfer material P fed from the pick-up rollers 22*a*, 22*b*, and a paper feed guide 24. The paper feed unit 20 has a registration roller 25 for feeding the transfer material P to a secondary transfer area Te in conformity with the image formation timing of each image forming portion 10. For example, A4-size paper is accommodated in cassette 21*a* longitudinally, and A4-size paper is accommodated in cassette 21*b* transversely. A cassette for accommodating A3-size paper may also be additionally provided. From which of these cassettes paper is fed is decided based upon a command from the control portion 80.

The details of the intermediate transfer portion 30 will now be described. The intermediate transfer belt 31 is tensioned by and wound on a driving roller 32, driven roller 33 and secondary transfer roller 34. The driving roller 32 transmits a driving force to the intermediate transfer belt 31. The driven roller 33, which is a tension roller that applies a suitable tension to the intermediate transfer belt 31 by the biasing force of a spring (not shown), follows up circulation of the intermediate transfer belt 31. A primary transfer plane A is formed on the surface of the intermediate transfer belt 31 that is situated between the driving roller 32 and driven roller 33. A material such as PET (polyethylene terephthalate) or PVF, (polyvinylidene fluoride) is used as the intermediate transfer belt 31. The driving roller 32 consists of a metal roller the surface of which is coated with rubber (urethane or chloroprene) to a thickness of several millimeters in order to prevent the belt 31 from slipping. The driving roller 32 is rotatively driven by a pulsed motor (not shown).

Primary-transfer charging units 35*a* to 35*d* ("primary-charging unit 35" below) are disposed at respective ones of the primary transfer areas Ta to Td where the photosensitive drums 11 oppose the intermediate transfer belt 31. The primary-charging unit 35 is in contact with the underside of the intermediate transfer belt 31. A secondary transfer roller 36 is placed opposite the secondary transfer roller 34. The secondary transfer area Te is formed by a nip between the secondary transfer roller 36 and intermediate transfer belt 31. The secondary transfer roller 36 is pressed against the intermediate transfer belt 31 at a suitable pressure.

The cleaning portion 50 for cleaning the image forming surface of the intermediate transfer belt 31 is disposed downstream of the secondary transfer area Te of intermediate transfer belt 31. The cleaning portion 50 is equipped with a cleaning blade 51 for removing toner on the intermediate transfer belt 31, and a waste-toner box 52 that receives waste toner.

Further, the driving roller 32 has a cleaning portion 70 such as a cleaning blade, and a pulse motor 71 for bringing the cleaning portion 70 into and out of contact with the intermediate transfer belt 31. The cleaning portion 70 also removes toner from the intermediate transfer belt 31.

The fixing unit 40 has a fixing roller 41*a,* which is internally provided with a heat source such as a halogen heater, and a roller 41*b* (there are cases where this roller is also provided with a heat source) for applying pressure to the fixing roller 41*a.* The fixing unit 40 further includes a guide 43 for guiding the transfer material P to the nip of the roller pair 41*a,* 41*b,* and insulated covers 46, 47 for confining the heat from the fixing unit in the interior of the fixing unit. The fixing unit 40 further includes inner paper-discharge rollers 44 and outer paper-discharge rollers 45 for guiding the transfer material P, which has been ejected from the roller pair 41*a,* 41*b,* to the exterior of the apparatus, and a paper-drop tray 48 on which the transfer material P is stacked.

Figure 2:
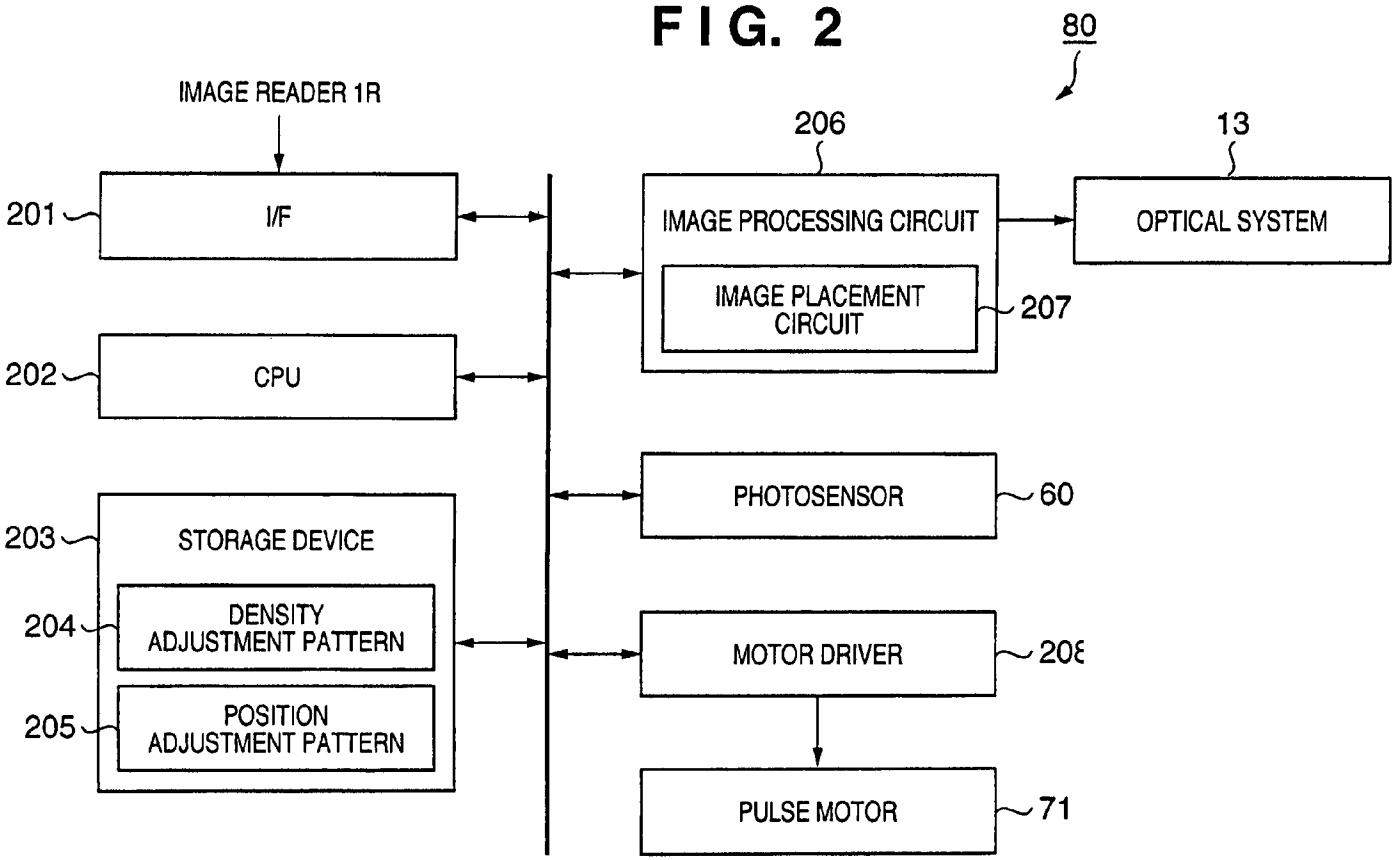
FIG. 2 is an illustrative block diagram of a control portion according to the first embodiment.

FIG. 2 is an illustrative block diagram of a control portion according to the embodiment. An interface 201 is a circuit for receiving an image signal from the image reader 1R. A CPU 202 is a control circuit for controlling the operation of the mechanisms in each of the units. The CPU 202 automatically adjusts an image formation position based upon the position of formation of an adjustment pattern read by the photosensor 60, and automatically adjusts image formation density based upon the density of the read adjustment pattern. The CPU 202 further determines the size of an image to be formed and can exercise control so as to abort the formation of the adjustment pattern if the size has a size (e.g., A3) that is greater than a prescribed size (e.g., A4).

A storage device 203 is a storage circuit such as a RAM, ROM or hard-disk drive. The storage circuit 203 stores image data 204 representing a density adjustment pattern used when automatically adjusting image formation density, and image data 205 representing a position adjustment pattern used when automatically adjusting image formation position. An image processing circuit 206 generates an image signal representing an image to be formed and outputs the signal to the optical system 13.

When an image has a size less than a prescribed size, an image placement circuit 207, which implements one function of the image processing circuit 206, decides placement of an image to be formed in such a manner that a vacant area for forming an adjustment pattern will be reserved on the intermediate transfer belt 31. The image placement circuit 207 reserves a vacant area outside the image formation area along the main-scan direction (belt transport direction) by deciding image placement in such a manner that the short side, for example, of the image will lie along the main-scan direction on the intermediate transfer belt 31. For instance, the image placement circuit 207 has an image rotating function for rotating an image in such a manner that the short side of the image to be formed will lie along the main-scan direction of the intermediate transfer belt 31 in a case where the long side of an image to be formed lies along the main-scan direction of the belt. By way of example, an image of size A4 can be rotated 90° to obtain an image of size A4R. It goes without saying that all of the processing of image placement circuit 207 may be performed by the CPU 202 and a control program.

A motor driver 208 is a drive circuit for driving the pulse motor 71 and various other motors, etc. For example, the motor driver 208 drives the pulse motor 71 in accordance with a command from the CPU 202, thereby bringing the cleaning portion 70 into contact with the intermediate transfer belt 31. This removes the adjustment pattern from the belt. On the other hand, when the cleaning of the adjustment pattern from the belt is completed, the motor driver 208 drives the pulse motor 71 to separate it from the intermediate transfer belt 31.

<Example of Operation in Image Formation Processing>

When a signal to start image formation is issued by the CPU 202, the transfer material P is fed by the pick-up roller 22 one sheet at a time from the cassette 21 storing the transfer material of a size specified by the CPU 202. The transfer material P is transported toward the registration roller 25 along the paper feed guide 24 by the paper feed rollers 23. At this time the registration roller 25 is at rest and the leading edge of the transfer material P is thrust into the nip. The registration roller 25 then starts to rotate in conformity with the timing of the start of image formation. This timing has been set in such a manner that the toner image transferred to the intermediate transfer belt 31 by primary transfer and the transfer material P will coincide in the secondary transfer area Te.

On the other hand, the toner image that has been formed on the photosensitive drum 11*d* farthest upstream is transferred by primary transfer to the intermediate transfer belt 31 by the primary-charging unit 35*d* to which a high voltage is applied. The toner image that has been primary-transferred to the intermediate transfer belt 31 is transported to the next primary transfer area Tc in accordance with travel of the intermediate transfer belt 31. At the image forming portion 10*c,* which is the next in line, image formation is performed at a timing delayed by a length of time necessary for the toner image to be transported between image forming portions. That is, once the image formation position has been adjusted, the next toner image is transferred. Similar steps are subsequently repeated so that toner images of four colors will eventually be transferred to the intermediate transfer belt 31 by multiple transfer.

The transfer material P thenceforth advances to the secondary transfer area Te and comes into contact with the intermediate transfer belt 31, whereupon a high voltage is impressed upon the secondary transfer roller 36 in conformity with the timing at which the transfer material P passes by. As a result, toner images of four colors that have been formed on the intermediate transfer belt 31 are transferred to the surface of the transfer material P. The transfer material P is thenceforth guided to the nip of the fixing rollers accurately by the transport guide 43. The toner images are thermally transferred to the surface of the transfer material P by the heat and pressure of the pair of fixing rollers 41*a,* 41*b.* The transfer material P is then transported by the inner and outer paper-discharge rollers 44, 45 to discharge the transfer material P to the exterior of the apparatus so that the transfer material P stacks up on the paper-drop tray 48.

<Processing for Automatic Adjustment of Image Formation Position>

Figure 3:
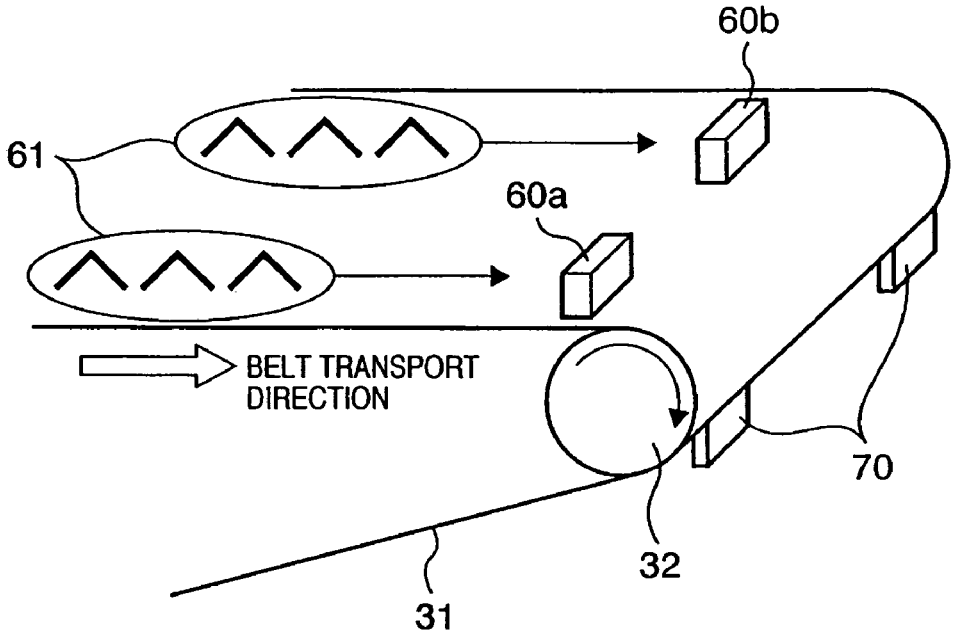
FIG. 3 is a diagram illustrating an example of formation of a position adjustment pattern according to the first embodiment.

FIG. 3 is a diagram illustrating an example of formation of a position adjustment pattern according to the embodiment.

The photosensor 60 (60*a*, 60*b*), which is a pattern reading portion, is placed between the photosensitive drum 11*a*, which is that among the plurality of photosensitive drums that is situated farthest downstream in the direction of belt advance, and the driving roller 32. The photosensors 60*a*, 60*b* read patterns 61, which are for adjusting image formation position (this adjustment is also referred to as a "registration correction"), formed on the intermediate transfer belt 31.

In this embodiment, the CPU 202 reads the image data 205 of the position adjustment pattern 61 out of the storage device 203, sends the data to the image processing circuit 206 and forms the position adjustment pattern 61 using a prescribed position on the intermediate transfer belt 31 as a reference. It goes without saying that the position adjustment pattern 61 is formed as a toner image. The CPU 202 reads the pattern 61 by the photosensor 60 and detects misregistration of the image formation position on the photosensitive drum color by color. For example, the distance from the prescribed position to the position at which formation of the image adjustment pattern starts is detected as the amount of misregistration. Finally, the CPU 202 stores data, which is used for correcting the detected misregistration, in the storage device 203 and controls image formation processing using this data in such a manner that misregistration will be cancelled out in subsequent image formation processing.

<Processing for Automatic Adjustment of Image Formation Density>

Figure 4:
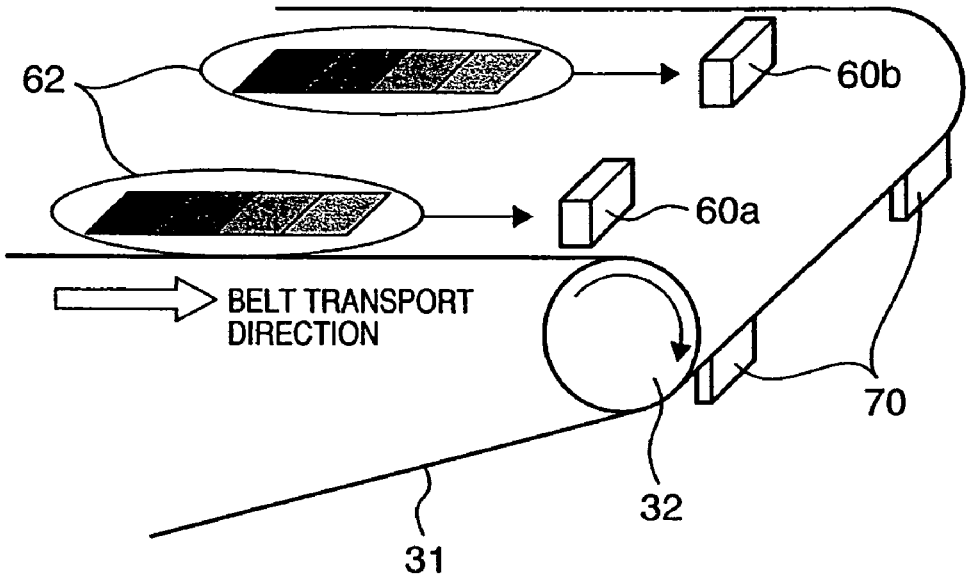
FIG. 4 is a diagram illustrating an example of formation of a density adjustment pattern according to the first embodiment.

FIG. 4 is a diagram illustrating an example of formation of a density adjustment pattern according to the embodiment. The CPU 202 reads the image data 204 of a density adjustment pattern out of the storage device 203, sends the data to the image processing circuit 206 and forms a density adjustment pattern 62 on the intermediate transfer belt 31. The CPU 202 reads the pattern 62 by a photosensor 60 and adjusts each of the process conditions in accordance with the density of the pattern 62 read. As a result, a prescribed density can be maintained and so can a uniform tonality.

It should be noted that the photosensor 60 (60*a*, 60*b*) is a dual unit for reading not only the pattern 61 for adjusting the image formation position but also the density adjustment pattern 62. This makes it possible to reduce the number of component parts and to exploit the space inside the apparatus effectively.

As should be evident from FIGS. 3 and 4, the cleaning portions (e.g., cleaning blades) 70 are placed only in the vicinity of the edges of the intermediate transfer belt 31 in a direction (referred to as the "main-scan direction") perpendicular to the belt transport direction (referred to as the "sub-scan direction"). This is to so arrange it that only the position adjustment patterns 61 or density adjustment patterns 62 can be removed. An A4R image or the like can be formed as usual in the area not contacted by the cleaning portions 70 (i.e., in the area between the two cleaning portions 70). As a result, automatic adjustment of the image formation position and automatic adjustment of the image formation density can be carried out even during execution of image formation.

The cleaning portions 70 are brought into contact with the intermediate transfer belt 31 by the pulse motor 71 when the position adjustment pattern is formed and when the density adjustment pattern is formed. As a result, the pattern that has been read by the photosensor 60 can be removed. On the other hand, when an image of size A4 or size A3 is formed, the area of the intermediate transfer belt 31 along the main-scan direction is used substantially in its entirety. In this case, the area for forming the adjustment pattern cannot be fully reserved and, as a consequence, automatic adjustment cannot be carried out. Accordingly, the CPU 202 drives the pulse motor 71 to move the cleaning portions 70 away from the intermediate transfer belt 31.

<Example of Adjustment-Pattern Formation Position>

Figure 5:
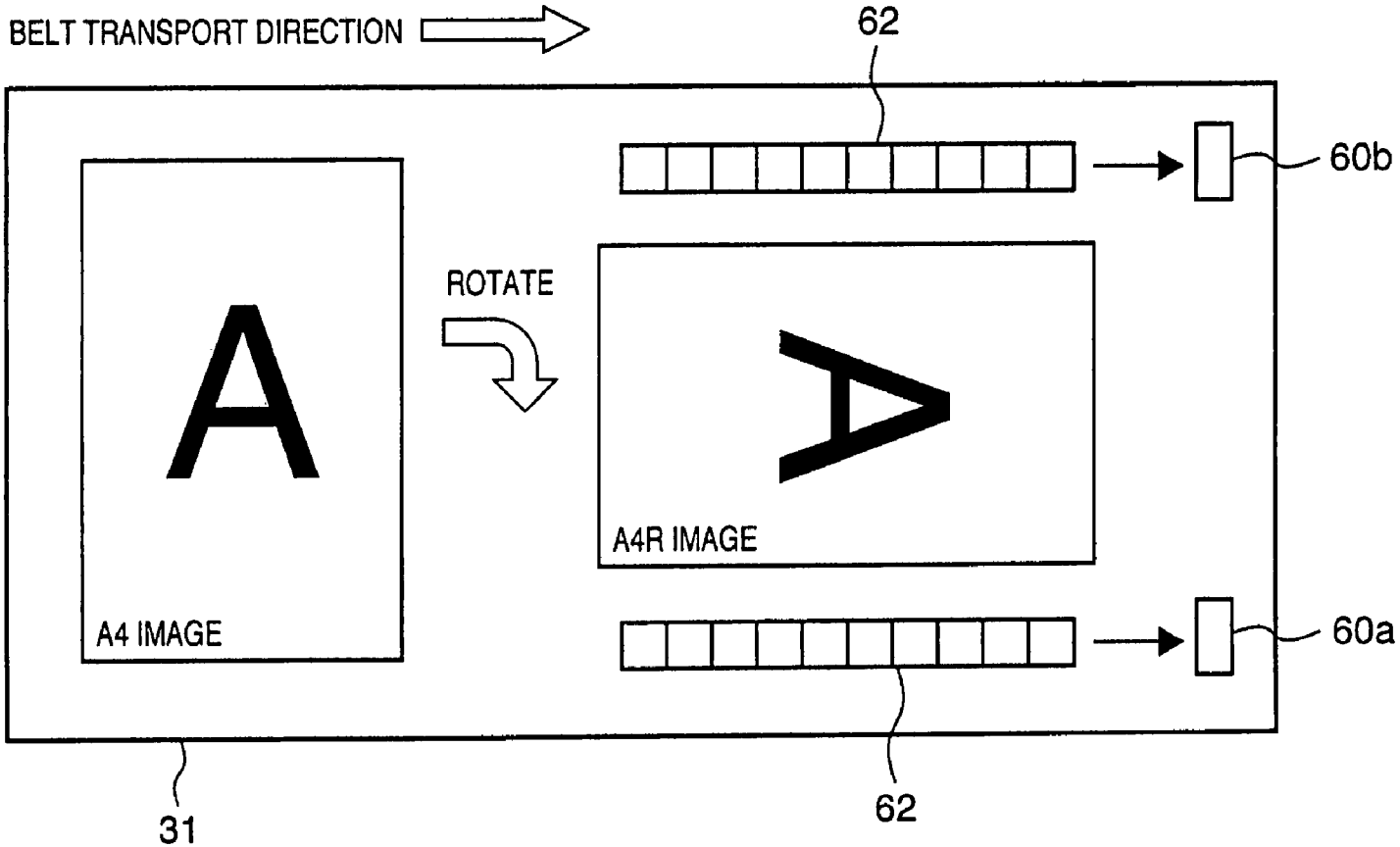
FIG. 5 is a plan view illustrating the position at which an adjustment pattern is formed according to the first embodiment.

FIG. 5 is a plan view illustrating the position at which an adjustment pattern is formed according to this embodiment. As evident from FIG. 5, it can appreciated that when an image of size A4 is formed, there is not enough area for forming the adjustment pattern 61 or 62. However, if the image of size A4 is rotated by 90° to obtain an image of size A4R (in which the short sides lie parallel with the main-scan direction) and the image is transferred to the approximate center of the intermediate transfer belt 31 in the main-scan direction, then adequate vacant areas can be reserved along the edges of the intermediate transfer belt 31 in the main-scan direction. The adequate vacant areas are none other than areas in which the adjustment patterns can be formed.

Accordingly, this embodiment is such that in a case where the size of an image to be printed is equal to or less than a prescribed size, it will suffice to rotate the image by 90° using the image placement circuit 207 and adjust the output timing of the image signal so as to place the image at the approximate center of the intermediate transfer belt 31 in the main-scan direction. By way of example, the prescribed size is A4 (210×297 mm) or LTR (216×279 mm), etc., which is generally referred to as a small size. That is, it is possible to reserve an area that enables the formation of an adjustment pattern without having an effect upon the image that is to be formed. The position adjustment pattern 61 or density adjustment pattern 62 is formed in the reserved area.

In accordance with this embodiment, two sensors 60 for sensing adjustment patterns are provided at respective peripheral area of the intermediate transfer belt 31 and therefore an image that has been rotated 90° is placed at the approximate center area of the belt 31 in the main-scan direction. The peripheral area is located between an edge of the belt 31 and a portion that is away from the edge and offsets from the center of the belt 31. However, if one sensor 60 is provided only at one peripheral area of the intermediate transfer belt 31 or if the short side of an image is made somewhat shorter, then it will not be necessary to place the image at the approximate center in the main-scan direction. It will suffice instead to decide placement of the image at a position that will make it possible to reserve the area in which the adjustment pattern can be formed. Placement of the image in this case is such that the image is offset toward one peripheral area of the intermediate transfer belt 31 from the center thereof in the main-scan direction.

Finally, since it is possible to form an adjustment pattern at the peripheral area or peripheral areas concurrently that the usual image is formed, it is possible to substantially eliminate loss time involved in automatic adjustment processing according to the prior art.

It should be noted that only the adjustment pattern is removed by the cleaning portion 70 and that the toner image to be printed is maintained on the intermediate transfer belt 31. This means that almost no unnecessary toner (the adjustment pattern) reaches the secondary transfer roller 36. The toner image is subsequently transferred to the transfer material P by the secondary transfer roller 36 situated downstream. The toner image is then fixed to the surface of the transfer material P by the fixing unit 40.

<Adjustment-Pattern Formation Timing>

The image formation position or density fluctuates owing to a fluctuation in the optical path of the laser beam due to a temperature inside the apparatus, a fluctuation in the transfer characteristics or a fluctuation in amount of toner in the developing unit. Accordingly, an automatic adjustment should be made whenever the number of prints reaches a prescribed value (e.g., 200) or whenever a prescribed time arrives.

Figure 6:
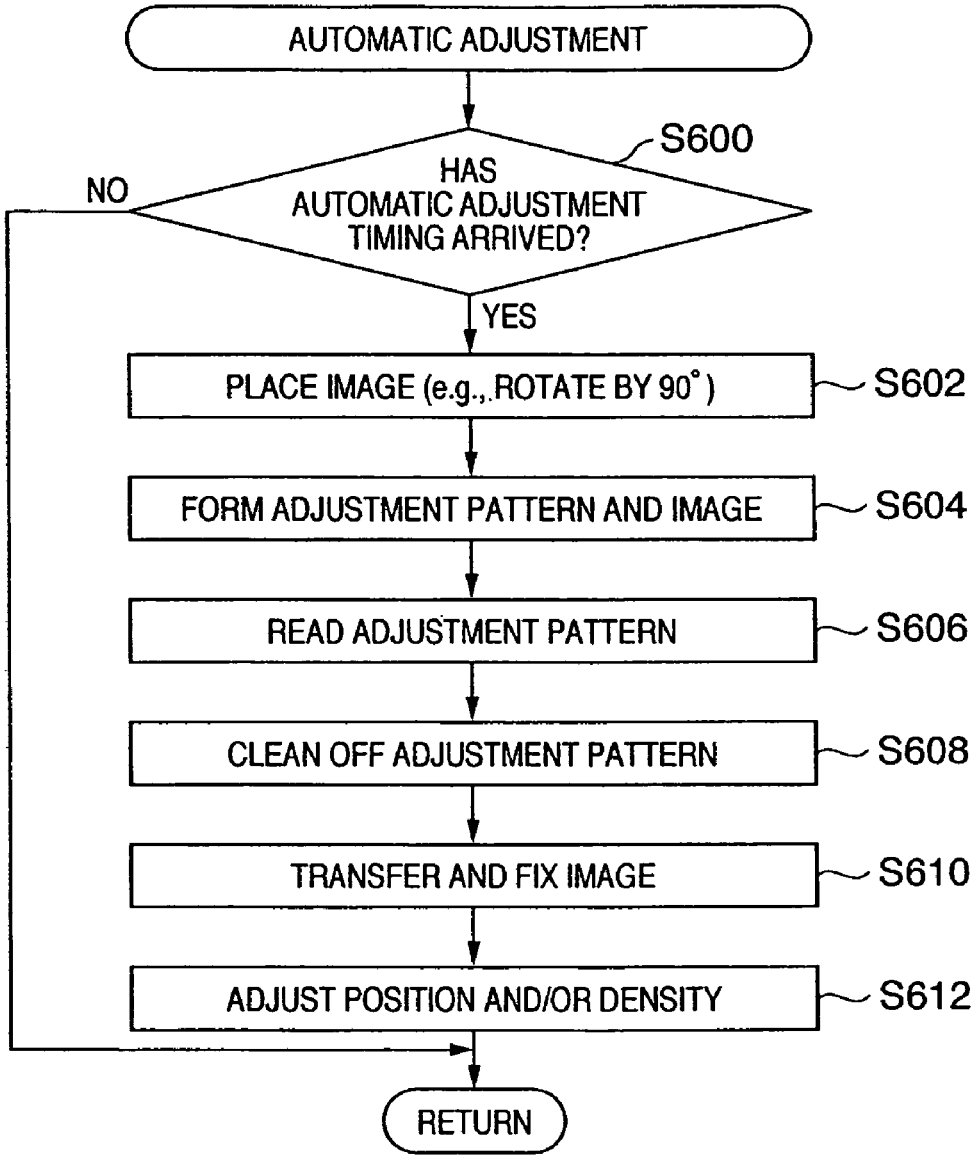
FIG. 6 is an illustrative flowchart of automatic adjustment processing according to the first embodiment.

FIG. 6 is an illustrative flowchart of automatic adjustment processing according to the embodiment. A control program necessary to execute this automatic adjustment processing has been stored in the storage device 203.

At step S600 in FIG. 6, the CPU 202 determines whether or not the timing for starting automatic adjustment has arrived. For example, the CPU 202 counts the number of sheets that have been printed since the last time the adjustment ended and determines that the timing for starting the automatic adjustment has arrived if the value of the count is a prescribed number (e.g., 200). Automatic adjustment processing is exited if start timing has not arrived.

If automatic adjustment timing has arrived ("YES" at step S600), then the CPU 202 uses the image placement circuit 207 and places the image to be formed in such a manner that an area for forming an adjustment pattern can be reserved. For example, the image is placed in such a manner that the short sides of the image will lie parallel with the main-scan direction of the intermediate transfer belt 31 and such that the position of the image in the main-scan direction is adjusted. As a result, a vacant area can be reserved outside the image formation area in the main-scan direction. If the long sides of the image to be formed lie along the main-scan direction of the intermediate transfer belt 31, for example, then the image placement circuit 207 rotates the image in such a manner that its short sides will lie along the main-scan direction. Stated more simply, an image of size A4 is made an image of size A4R by being rotated through an angle of 90°.

It should be noted that the sheet fed is changed from size A4 to size A4R at this time. Further, in the event that sheets of size A4R have not been loaded in the apparatus, the 90° rotation of the A4-size image is inhibited. In such case the automatic adjustment processing is performed upon suspending the image forming operation or is performed after the image forming operation.

The image to be formed is formed on the intermediate transfer belt 31 together with the adjustment pattern by the CPU 202 at step S604. It goes without saying that both are formed as toner images. Further, the adjustment pattern includes at least one of the position adjustment pattern 61 and density adjustment pattern 62.

Next, at step S606, the CPU 202 uses the photosensor 60 to read the adjustment pattern that has been formed on the intermediate transfer belt 31. The read data is stored in the storage device 203 temporarily.

This is followed by step S608, at which the CPU 202 drives the pulse motor 71 to bring the cleaning portion 70 into contact with the intermediate transfer belt 31 and successively remove the adjustment pattern (toner image) whose reading has been completed.

Next, at step S610, the CPU 202 drives the intermediate transfer belt 31 further to transfer the toner image of the image to be formed to the transfer material by the secondary transfer roller 36. The toner image on the transfer material is thermally fixed by the fixing unit 40.

Finally, at step S612, the CPU 202 adjusts the image formation position or image formation density based upon the read data that has been stored in the storage device 203.

Figure 7:
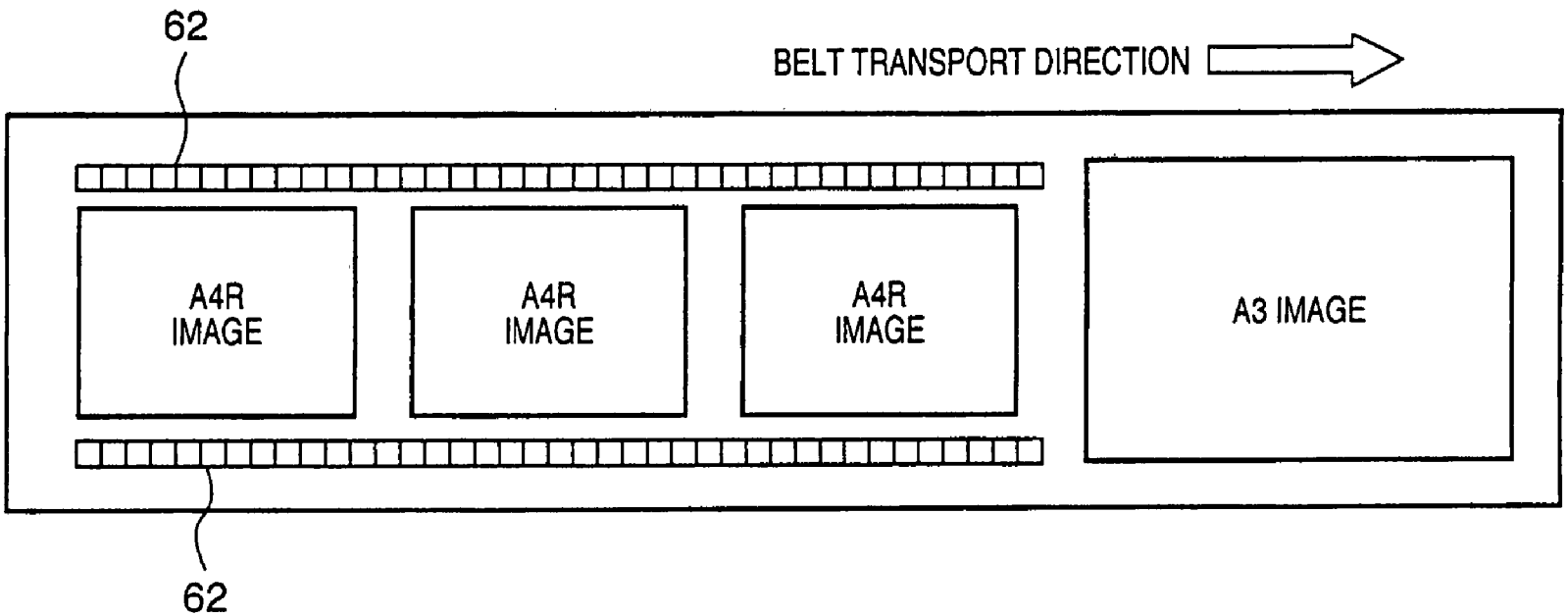
FIG. 7 is a plan view illustrating an intermediate transfer belt on which an adjustment pattern and ordinary images have been formed according to the first embodiment.

FIG. 7 is a plan view illustrating an intermediate transfer belt on which an adjustment pattern and ordinary images have been formed according to this embodiment. As will be evident from FIG. 7, an A3-size image, which is an image whose size exceeds the prescribed size, cannot be formed and automatically adjusted concurrently. However, if an image has a size equal to or than the prescribed size, e.g., if the image is of size A4, then the adjustment patterns can also be formed simultaneously and concurrently by rotating the A4-size image 90° to obtain an A4R-size image.

Thus, as described above, this embodiment is such that when an image that is equal to or less than a prescribed size (an image whose size is equal to or less than A4) is formed, the image can be formed on the intermediate transfer belt 31 in concurrence with the adjustment pattern by careful placement of the image. As a result, an image can be adjusted automatically with regard to image formation position (registration) or image formation density while image formation is executed in the usual fashion. The present invention therefore is advantageous in that it greatly shortens the waiting time that was required for automatic adjustment in the prior art.

By way of example, by placing an image in such a manner that its short sides lie in the main-scan direction of the carrier (e.g., the intermediate transfer belt 31), a vacant area that makes possible the formation of an adjustment pattern can be reserved outside the image formation area of the carrier along the main-scan direction. Such placement is achieved by rotating the image. More specifically, an A4-size image, for example, need only be rotated to become an A4R-size image. Downtime due to automatic adjustment can be curtailed by forming the adjustment pattern in the vacant area (along the edge of the carrier in the main-scan direction) thus reserved.

Further, by providing the cleaning portion 70 that cleans only the adjustment patterns 61, 52 formed on the intermediate transfer belt 31, automatic adjustment processing can be executed without damaging the image to be formed. When the cleaning portion 70 cleans the adjustment pattern, it comes into contact with the intermediate transfer belt 31 in operative association with the pulse motor 71. When cleaning of the adjustment pattern ends, on the other hand, the cleaning portion 70 separates from the intermediate transfer belt 31 in operative association with the pulse motor 71. This diminishes the possibility that the toner image of the adjustment pattern will contaminate the secondary transfer roller 36.

Furthermore, the photosensor 60 (60*a*, 60*b*) doubles as a unit for reading not only the pattern for adjusting the image formation position but also the density adjustment pattern 62, thereby reducing the number of parts and utilizing the space inside the apparatus more effectively.

Second Embodiment

Figure 8:
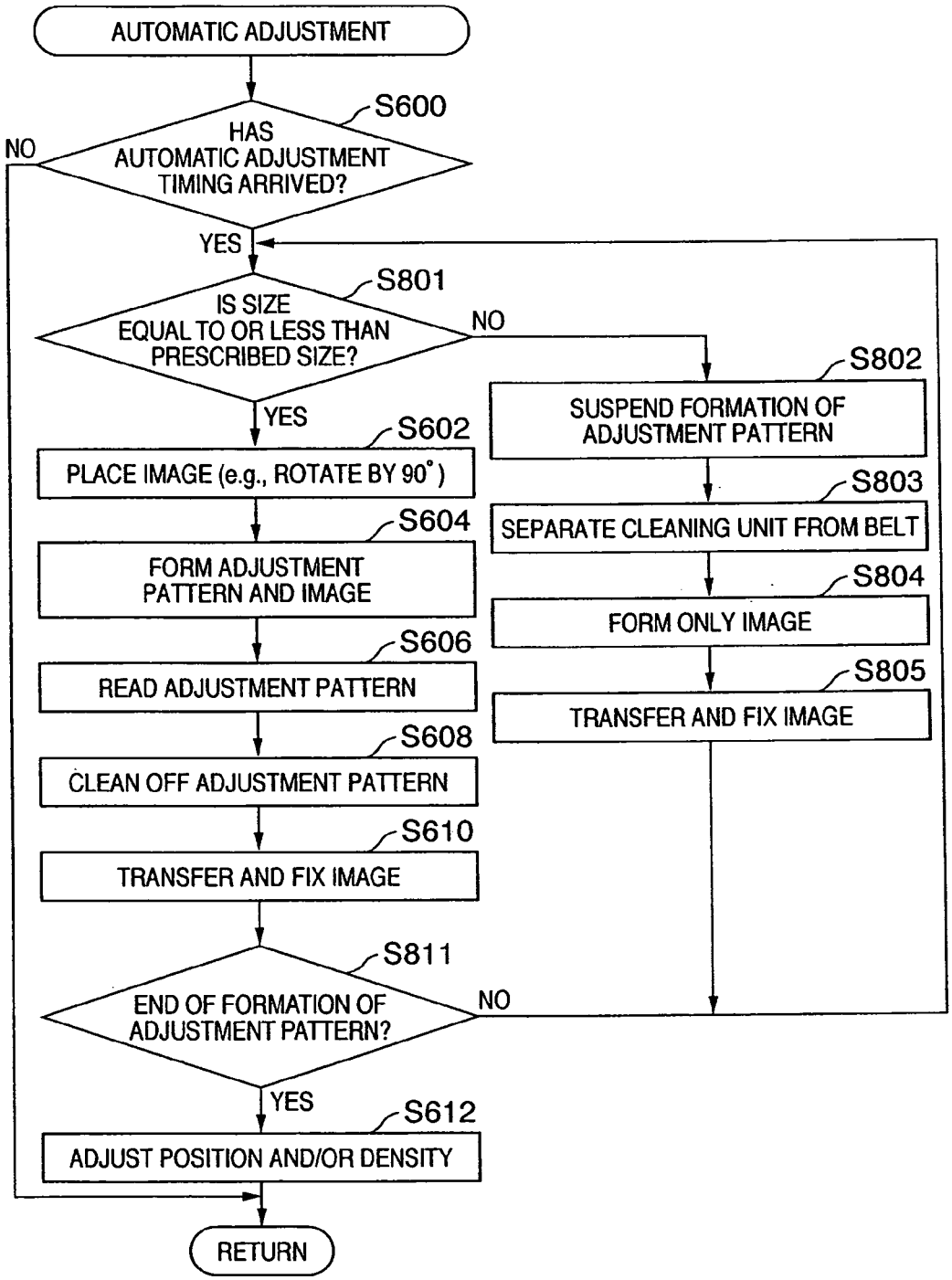
FIG. 8 is an illustrative flowchart of automatic adjustment processing according to a second embodiment of the present invention.

FIG. 8 is an illustrative flowchart of automatic adjustment processing according to a second embodiment of the present invention. Here processing steps already described in conjunction with FIG. 6 are designated by like step numbers and need not be described again.

In processing for forming images, there are occasions where an image of size A3 is formed while the formation of a plurality of size-A4 images is underway. There are also cases where the length of an adjustment pattern is greater than the length of the long side of an A4 image. Under such circumstances, there is a possibility that the formation of the A3 image will start before the formation of the adjustment pattern ends. As a consequence, there is the danger that the two images will be formed overlapping each other or that part of the A3-size image will be erased by the cleaning portion 70 for cleaning the adjustment pattern. An automatic adjustment processing for when a plurality of images of different sizes are formed will now be described.

At step S801 in FIG. 8, the CPU 202 determines whether the size of the image to be formed is equal to or less than a prescribed size. If a "YES" decision is rendered, the above-described processing of steps S602 to S610 is executed. Then, at step S811, the CPU 202 determines whether formation of the adjustment pattern has ended or not. If formation of the adjustment pattern has not ended, control returns to step S801 and the CPU 202 discriminates the size of the next image to be formed.

If the size of the image to be formed exceeds the prescribed size, control proceeds to step S802. For example, if the prescribed size has been set to A4, then an image of size A3 obviously exceeds the prescribed size.

The CPU 202 aborts the formation of the adjustment pattern at step S802. For example, the CPU 202 halts the transmission of image data of the adjustment pattern to the image processing circuit 206.

Next, at step S803, the CPU 202 drives the pulse motor 71 to cause the cleaning portion 70 to separate from the intermediate transfer belt 31. As a result, it can be so arranged that the edge portion of an image such as an image of size A3 will not be erased accidentally.

Next, at step S804, the CPU 202 exercises control in such a manner that the toner image regarding the image to be formed is formed on the intermediate transfer belt 31 in the usual fashion without forming the adjustment pattern. Then, at step S805, the CPU. 202 controls the secondary transfer roller 36 to execute transfer processing and further controls the fixing unit 40 to execute fixing processing. Control thenceforth returns to step S805.

It should be noted that if an image whose size is equal to or less than the prescribed size is detected again, the CPU 202 transitions to step S602 and resumes the formation of the adjustment pattern.

Figure 9:
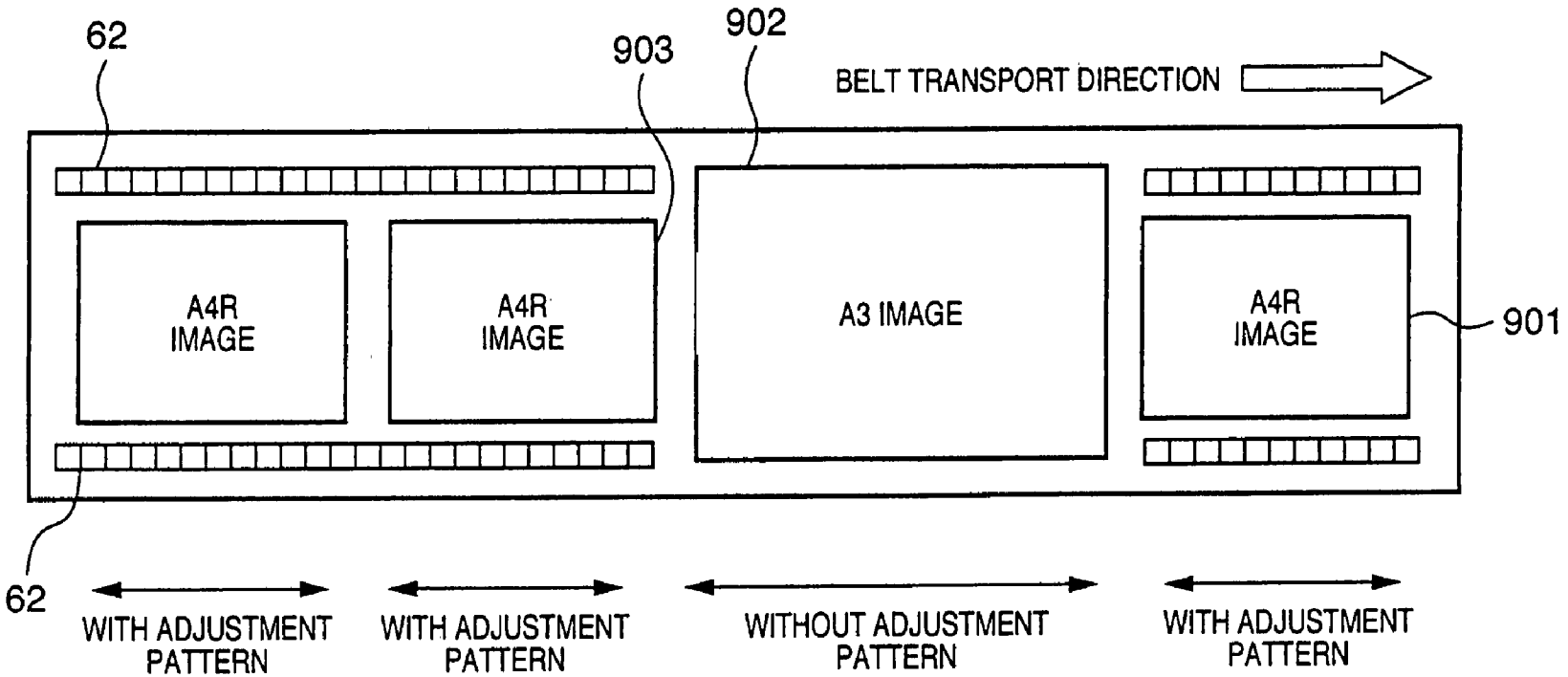
FIG. 9 is a plan view illustrating an intermediate transfer belt on which adjustment patterns and ordinary images have been formed according to the second embodiment.

FIG. 9 is a plan view illustrating an intermediate transfer belt on which adjustment patterns and ordinary images have been formed according to the second embodiment. It will be apparent from FIG. 9 that an A3-size image 902 has been formed following the formation of an A4R-size image 901. When this A3-size image is formed, a sufficient vacant area cannot be reserved on the intermediate transfer belt 31 in the main-scan direction. Accordingly, formation of the adjustment pattern is being aborted during the formation of the A3-size image 902. Next, when the formation of A4R-size image 903 starts, the formation of the adjustment pattern is resumed.

Thus, in accordance with the second embodiment, the size of the image to be formed is determined and control is exercised in such a manner that formation of the adjustment pattern is aborted if the size of the image to be formed is greater than the prescribed size. As a result, an adjustment pattern can be formed in ideal fashion even in image formation processing in which images whose size is greater than the prescribed size and images whose size is equal to or less than the prescribed size are mixed. For instance, if formation of an image whose size is greater than the prescribed size starts before the end of formation of the adjustment pattern, the present invention in this embodiment makes it possible to avoid the problem of overlap of the two images and the problem of erasure of part of the image by the cleaning portion 70.

It should be noted that in a case where stapling processing has been set in a print job in which A4 images and A3 images are mixed, the lengths of the sheets on the side stapled will no longer coincide if image formation is carried out upon rotating the A4 images. In such case it is so arranged that the A4 images are not rotated 90°.

Other Embodiments

In the embodiments set forth above, the invention has been described with regard to an electrophotographic color copier 100 having a plurality of image forming portions 10. It goes without saying, however, that the present invention is also effective in a single-drum color image forming apparatus having a single image forming portion.

Figure 10:
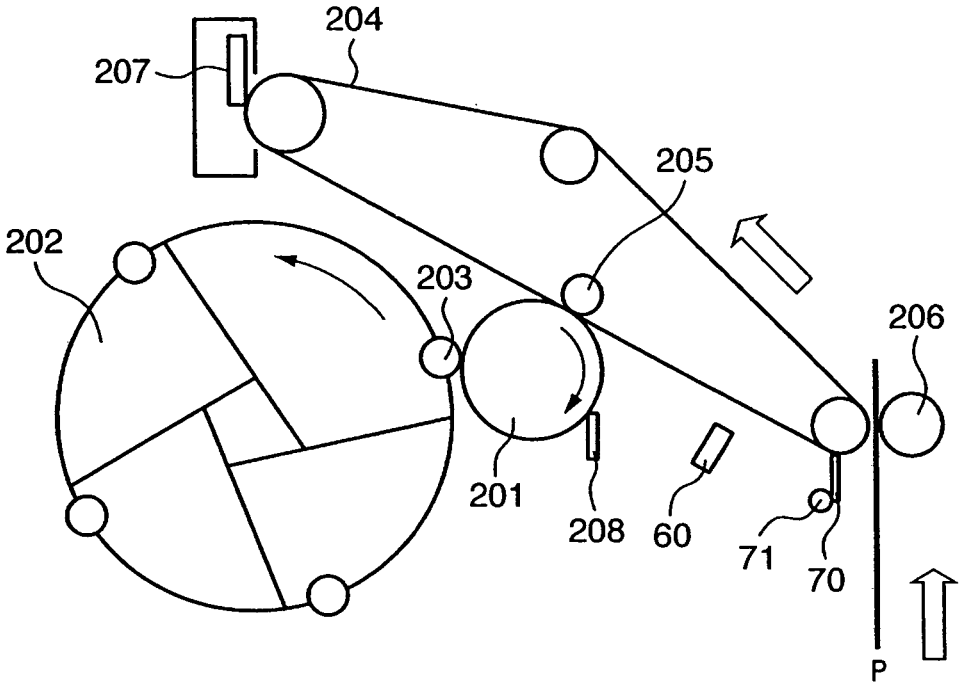
FIG. 10 is a diagram illustrating the principal parts of a single-drum color image forming apparatus according to another embodiment of the invention.

FIG. 10 is a diagram illustrating the principal parts of a single-drum color image forming apparatus according to another embodiment of the invention. When a latent image that has been formed on a photosensitive drum 201 that rotates in the clockwise direction arrives as a sleeve 203 of a first color in a 4-color developing rotary 202 that rotates in the counter-clockwise direction, the toner of the first color is adsorbed onto the surface of the photosensitive drum 201. The electrostatic latent image is developed as a result. The toner image that has been formed on the photosensitive drum 201 is transferred to an intermediate transfer member 204, which rotates in the counter-clockwise direction, by a primary transfer roller 205. In a case where a full-color image is formed, the intermediate transfer member 204 is rotated four times to thereby transfer four toner images of different colors to the intermediate transfer member 204 my multiple transfer. This completes a single transfer of a full-color image.

Meanwhile, the toner image on the intermediate transfer member 204 is transferred to printing paper P by secondary transfer using a secondary transfer roller 206. It should be noted that residual toner is removed by a cleaning blade 207 capable of being brought into and out of contact with the surface of the intermediate transfer member 204. Residual toner on the photosensitive drum 201 is removed by a blade 207.

The above-described photosensor 60 is disposed between the primary transfer roller 205 and secondary transfer roller 206 in order to sense the adjustment pattern that has been transferred to the intermediate transfer member. The cleaning portion 70 that cleans only the adjustment pattern is situated farther upstream than the secondary transfer roller 206. The pulse motor 71 brings the cleaning portion 70 into and out of contact with the surface of the intermediate transfer member 204 as above described. With regard to components other than those of the image forming portion, these have already been described and need not be described again.

Thus, the outstanding effects set forth above can be obtained in a case where the present invention is applied to a single-drum color image forming apparatus. For example, when an image that is equal to or less than a prescribed size (an image whose size is equal to or less than A4) is formed, the image can be formed on the intermediate transfer member 204 concurrently as the adjustment pattern by careful placement of the image. As a result, an image can be adjusted automatically with regard to image formation position (registration) or image formation density while image formation is executed in the usual fashion. The present invention therefore is advantageous in that it greatly shortens the waiting time that is required for automatic adjustment in the prior art. In other words, the invention shortens downtime due to automatic adjustment.

In the foregoing embodiments, the adjustment pattern is removed using the cleaning portion 70 so that needless toner will not attach itself to the secondary transfer rollers 36, 206. A plurality of secondary transfer rollers having different lengths may be adopted instead of providing the cleaning portion 70, which is exclusively for the adjustment pattern. The plurality of secondary transfer rollers can then be changed over between those used when an ordinary image is formed and those used when an adjustment pattern is used, whereby contamination of the secondary transfer rollers by the toner is suppressed.

Figure 11:
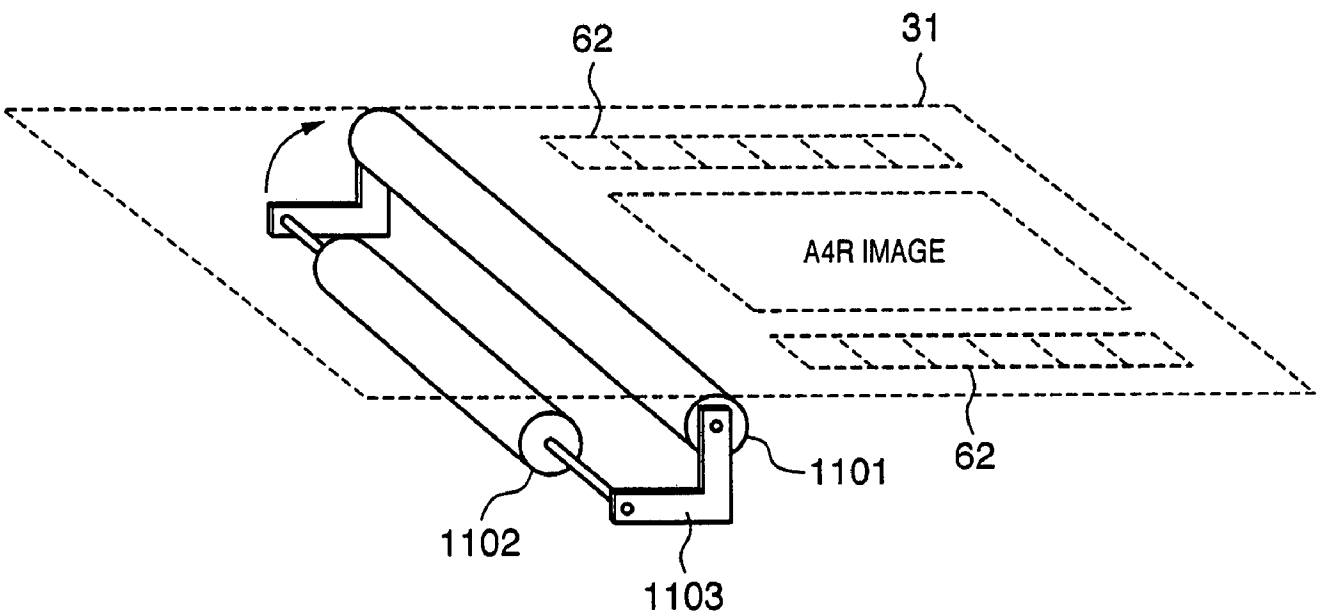
FIG. 11 is a diagram illustrating a plurality of secondary transfer rollers according to another embodiment of the invention.

FIG. 11 is a diagram illustrating a plurality of secondary transfer rollers according to another embodiment of the invention. In this example, the above-mentioned secondary transfer rollers 36, 206 are constituted by two secondary transfer rollers 1101, 1102. One secondary transfer roller, namely that at numeral 1102, has a length identical with the length of the intermediate transfer belt 31 in the main-scan direction. The other secondary transfer roller 1102 has a length that is smaller than the length of the intermediate transfer belt 31 in the main-scan direction. More specifically, the secondary transfer roller 1102 has a length equal to that of the short side of the image having the prescribed size mentioned above. That is, the secondary transfer roller 1102 does not have enough length to transfer the density adjustment pattern 62 to the transfer material P. Further, the secondary transfer roller 1102 is placed in close proximity to the central portion of the intermediate transfer belt 31.

The secondary transfer rollers 1101, 1102 are axially supported by two carriers 1103. The carriers 1103 are turned by a motor (not shown) driven by the motor driver 208. For example, at the time of image formation, the carriers 1103 are turned so as to bring the secondary transfer roller 1101 into contact with the intermediate transfer belt 31. It goes without saying that the transfer material P is interposed between the secondary transfer roller 1101 and the intermediate transfer belt 31.

On the other hand, when an image is formed together with an adjustment pattern, the carriers 1103 are turned so as to bring the secondary transfer roller 1102 into contact with the intermediate transfer belt 31. It should be noted that since the length of the secondary transfer roller 1102 is small enough to prevent this roller from touching the adjustment patterns, there is almost no contamination of the secondary transfer roller 1102 by the toner images. Furthermore, the toner images of the adjustment patterns are removed from the intermediate transfer belt 31 by the cleaning blade 51 located downstream.

As described above, contamination of the secondary transfer rollers by the toner images of the adjustment patterns can be suppressed by adopting the plurality of secondary transfer rollers 1101, 1102 of different lengths instead of the cleaning portion 70 exclusively for the adjustment patterns.

It goes without saying that this technical idea is not limited to the secondary transfer roller and can be applied to the primary transfer roller as well. In this case, it would be necessary to provide the photosensor 60 and the cleaning portion 70, which removes the adjustment patterns, on the photosensitive drum 11.

The present invention can be applied to a system constituted by a plurality of devices (e.g., a host computer, interface, reader, printer, etc.) or to an apparatus comprising a single device (e.g., a copier or facsimile machine, etc.).

As many apparently widely different embodiments of the present invention can be made without departing from the spirit and scope thereof, it is to be understood that the invention is not limited to the specific embodiments thereof except as defined in the appended claims.

This application claims the benefit of Japanese Patent Application No. 2005-159938 filed on May 31, 2005, which is hereby incorporated by reference herein in its entirety.

What is claimed is:

1. An image forming apparatus comprising:

an image carrier configured to support an image produced by a developing material;

an image placement portion, which is operative when an image having a size equal to or less than a prescribed size is formed, configured to decide placement of the image on said image carrier so as to reserve a vacant area, which is provided for forming an adjustment pattern for adjusting at least one of an image formation position and an image formation density, on said image carrier;

an image forming portion configured to form the image on said image carrier in accordance with the decided placement, and for forming an adjustment pattern in the vacant area;

a reading portion configured to read the adjustment pattern that has been formed on said image carrier; and an adjustment portion configured to adjust at least one of the image formation position and the image formation density based upon the adjustment pattern that has been read, wherein said image placement portion reserves the vacant area outside an area, in which the image is formed, on said image carrier along a main-scan direction by deciding placement of the image in such a manner that short sides of the image will lie along the main-scan direction of said image carrier.

2. The apparatus according to claim 1, wherein said image placement portion includes an image rotating portion configured to rotate the image in such a manner that the short sides of the image will lie along the main-scan direction in a case where long sides of the image lie along the main-scan direction of the image carrier.

3. The apparatus according to claim 1, further comprising an inhibiting portion configured to inhibit reservation of the vacant area in a case where a print job includes an image having a size equal to or less than the prescribed size and an image having a size greater than the prescribed size and, stapling processing has been set.

4. The apparatus according to claim 1, wherein said reading portion detects a density adjustment pattern, which is provided for adjusting the image formation density, in addition to a position adjustment pattern, which is provided for adjusting the image formation position.

5. The apparatus according to claim 1, further comprising a cleaning portion configured to clean off the adjustment pattern that has been formed on said image carrier.

6. The apparatus according to claim 5, wherein said cleaning portion comes into contact with said image carrier when the adjustment pattern is cleaned off, and separates from said image carrier when cleaning off of the adjustment pattern ends.

7. An image forming apparatus comprising:

an image carrier configured to support an image produced by a developing material;

an image placement portion, which is operative when an image having a size equal to or less than a prescribed size is formed, configured to decide placement of the image on said image carrier so as to reserve a vacant area, which is for forming an adjustment pattern for adjusting at least one of image formation position and image formation density, on said image carrier;

an image forming portion configured to form the image on said image carrier in accordance with the placement decided, and for forming the adjustment pattern in the vacant area;

a reading portion configured to read the adjustment pattern that has been formed on said image carrier;

an adjustment portion configured to adjust at least one of the image formation position and image formation density based upon the adjustment pattern that has been read;

a size determination portion configured to determine the size of an image to be formed; and a control portion configured to exercise control so as to abort formation of the adjustment pattern in a case where the size of the image is greater than the prescribed size.

8. The apparatus according to claim 7, wherein said reading portion detects a density adjustment pattern, which is provided for adjusting the image formation density, in addition to a position adjustment pattern, which is provided for adjusting the image formation position.

9. The apparatus according to claim 7, further comprising a cleaning portion configured to clean off the adjustment pattern that has been formed on said image carrier.

10. An image forming apparatus comprising:

an image carrier configured to support an image produced by a developing material;

an image placement portion, which is operative when an image having a size equal to or less than a prescribed size is formed, configured to decide placement of the image on said image carrier so as to reserve a vacant area, which is for provided forming an adjustment pattern for adjusting at least one of an image formation position and an image formation density, on said image carrier;

an image forming portion configured to form the image on said image carrier in accordance with the placement decided, and for forming the adjustment pattern in the vacant area;

a reading portion configured to read the adjustment pattern that has been formed on said image carrier;

an adjustment portion configured to adjust at least one of the image formation position and image formation density based upon the adjustment pattern that has been read;

a first transfer portion configured to transfer the image to a print medium; and a second transfer portion having a length less than a length of said first transfer portion in the main-scan direction.

11. A method of controlling an image forming apparatus for forming an image utilizing an image carrier for supporting an image produced by a developing material, said method comprising the steps of:

deciding, when an image having a size equal to or less than a prescribed size is formed, placement of the image on the image carrier so as to reserve a vacant area, which is provided for forming an adjustment pattern for adjusting at least one of an image formation position and an image formation density, on the image carrier;

forming the image on the image carrier in accordance with the decided placement, and forming an adjustment pattern in the vacant area;

reading the adjustment pattern that has been formed on the image carrier; and adjusting at least one of the image formation position and image formation density based upon the adjustment pattern that has been read, wherein said step of deciding further includes a step of reserving the vacant area outside an area, in which the image is formed, on the image carrier along a main-scan direction by deciding placement of the image in such a manner that short sides of the image will lie along the main-scan direction of the image carrier.

12. A method of controlling an image forming apparatus for forming an image utilizing an image carrier for supporting an image produced by a developing material, said method comprising the steps of:

deciding, when an image having a size equal to or less than a prescribed size is formed, placement of the image on the image carrier so as to reserve a vacant area, which is provided for forming an adjustment pattern for adjusting at least one of an image formation position and an image formation density, on the image carrier;

forming the image on the image carrier in accordance with the decided placement, and forming an adjustment pattern in the vacant area;

reading the adjustment pattern that has been formed on the image carrier;

adjusting at least one of the image formation position and the image formation density based upon the adjustment pattern that has been read;

determining the size of an image to be formed; and exercising control so as to abort formation of the adjustment pattern in a case where the size of the image to be formed is greater than the prescribed size.

* * * * *